United States Patent [19]

Sasaki et al.

[11] Patent Number: 4,907,438

[45] Date of Patent: Mar. 13, 1990

[54] SIZING MILL AND METHOD OF ROLLING A ROUND BAR MATERIAL

[75] Inventors: Takeshi Sasaki, Chita; Kiyoharu Morita, Aichi, both of Japan

[73] Assignee: Daidotokushuko Kabushikikaisha, Japan

[21] Appl. No.: 256,428

[22] Filed: Oct. 12, 1988

[30] Foreign Application Priority Data

Oct. 30, 1987 [JP] Japan ..... 62-277211

[51] Int. Cl.[4] ..... B21B 13/12

[52] U.S. Cl. ..... 72/235

[58] Field of Search ..... 72/235

[56] References Cited

U.S. PATENT DOCUMENTS

| | | | |
|---|---|---|---|
| 2,369,730 | 2/1945 | Fisk | 72/235 X |
| 3,336,781 | 8/1967 | Wilson et al. | 72/235 |
| 3,996,781 | 12/1976 | Nuckel | 72/235 X |
| 4,392,370 | 7/1983 | Strandell | 72/235 X |
| 4,537,055 | 8/1985 | Woodrow et al. | 72/235 |
| 4,669,293 | 6/1987 | Kusaba et al. | 72/235 |
| 4,744,234 | 5/1988 | Poloni | 72/235 |

FOREIGN PATENT DOCUMENTS

| | | | |
|---|---|---|---|
| 1282582 | 11/1968 | Fed. Rep. of Germany | 72/235 |
| 1006943 | 10/1965 | United Kingdom | 72/235 |

*Primary Examiner*—W. Donald Bray
*Attorney, Agent, or Firm*—William A. Drucker

[57] ABSTRACT

A plurality of roll stands are arranged along a planned passage line of a roll material. Each of the roll stands is provided with a pair of rolls each of which is formed, on the outer circumferential surface thereof, with a groove for rolling. The bottom surface formed on each roll is a circular arc in cross section. Both side surfaces of the groove are, in cross section, circular arcs of a radius larger than that of the bottom surface or segments of line.

The roll material is transferred along the planned passage line is passed between the grooves on the pair of rolls in each roll stand. Thus, the roll material is rolled. In this case, even is the thickness of the roll material deviates, it can be rolled into a finished material of a prescribed dimension.

7 Claims, 8 Drawing Sheets

SIZING MILL AND METHOD OF ROLLING A ROUND BAR MATERIAL

BACKGROUND OF THE INVENTION

1. Field of the Invention

This invention relates to a sizing mill used in order to roll further a metallic material in the form of a round bar, which has been subjected to coarse and intermediate rollings in a hot rolling line, into a finished product of a prescribed diameter.

2. Description of the Prior art

A sizing mill comprises two or three roll stands arranged along a planned pass line of a roll material. Each roll stand is provided with a pair of rolls formed on the outer circumferential surface thereof with respective grooves. The roll material transferred along the planned pass line is passed through the grooves on the rolls in each roll stand. In this manner, the roll material is rolled into a finished material of a prescribed diameter.

In order to raise the accuracy in the diameter of the finished material, the followings are practiced in the company where the inventor is employed. Namely, after the diameter of the finished material is decided, the diameter of the roll material is determined, taking into account of the rate of area reduction. In the next place, the radius of circular arc in cross section of the bottom surface of the above mentioned groove is determined and the depth of the groove is determined at the same time.

Accordingly, the dimension of the finished material, after being rolled with use of the rolls provided with the grooves specified in the above mentioned manner, lies within regular tolerances if the radius of the roll material is within a prescribed tolerance. However, if there is a deviation beyond the prescribed tolerance in the diameter of the roll material, there appears a problem that a deviation corresponding to this deviation in the diameter of the roll material is brought about also in the diameter of the finished material and this deviation goes beyond an allowable limit.

Furthermore, in the sizing mill including rolls provided with grooves formed in the above mentioned manner, it is necessary to change the dimensions of the groove when a finished material of a different diameter is required. In this case, it is difficult to meet this requirement only by changing the spacing between a pair of rolls. Namely, an angle $\alpha$ made by a line passing the center 140*c* and one end 140*a* of such portion 140 of a groove 128 that is a circular arc in cross section and a line passing the center 140*c* and the other end 140*b* of the portion 140 as shown in FIG. 15 is set equal to a large value such as 170°.Then the contour defined by the grooves becomes practically a round. In order to obtain a finished material, for example, of a larger diameter with use of these rolls, the spacing between the bottoms of grooves is extended from W1 to W2. Then, the shoulder dimension between a pair of rolls (the distance between the tangent at one end of the circular arc of the groove on one of the rolls and the tangent at the other end of the circular arc of the groove on the other roll) is increased from X1 to X2. The margin length X resulting from the increased shoulder dimension is very small as is shown. Accordingly, when a roll material is transferred to the rolls with the enlarged spacing between bottom surfaces W2, the cross section of the finished material passed between the rolls becomes an ellipse. Therefore, it is difficult to obtain finished materials different in diameter only by changing the spacing between a pair of rolls.

For this reason, it is necessary to change the dimensions of the groove as well in order to obtain finished materials slightly different in diameter. Moreover, it is necessary to change also the diameter of the roll material in accordance the change of the above mentioned dimensions. These changes require the work of cutting the grooves over again and the work of rearranging the rolling processes at stages before the sizing mill. These works require long time and high cost.

SUMMARY OF THE INVENTION

A first object of the present invention is to provide a sizing mill which can provide a required finished material in the form of a round bar by rolling a roll material of a diameter larger than that of the finished material.

A second object of the present invention is to provide a sizing mill which can form roll materials into finished materials of a prescribed diameter even if the roll materials deviate largely in diameter.

According to the present invention, a groove on a roll consists of a bottom surface and side surfaces contiguous to both ends of the bottom surface. The bottom surface is a circular arc in cross section. The angle made by a line passing the center and one end of the circular arc and a line passing the center and the other end of the circular arc is determined to be a value selected in an interval of 90°~140°. On the other hand, the both side surfaces are determined to be, in cross section, circular arcs of a radius larger than that of the bottom surface or to be segments of line. Accordingly, roll materials of a diameter within a tolerance determined in the same manner as in a conventional case can be accepted to be rolled into finished materials of a prescribed diameter. Moreover, even such accepted roll materials that deviate in diameter beyond the tolerance can be rolled into finished materials of a prescribed diameter.

A third object of the present invention is to provide a sizing mill which can provide required finished materials slightly different in diameter without requiring to change the diameter of roll materials but only by changing slightly the spacing between a pair of rolls in a roll stand.

According to the present invention, the allowable range of diameter of a roll material is wider when it is required to obtain a finished material of a prescribed diameter. As a result, even when the diameter of the finished material is changed by changing the spacing between the rolls while keeping the diameter of the roll material unchanged, the unchanged diameter of the roll material can stay within the allowable range. Consequently, it becomes possible to provide finished materials of a required diameter without changing the diameter of the roll material but changing slightly the spacing between a pair of rolls in the roll stand.

The change of the diameter of the finished material by a method of this kind can be practiced in a very short time and at a slight cost.

Other objects and advantages of the inventions will become apparent during the following discussion of the accompanying drawings.

DESCRIPTION OF THE PREFERRED EMBODIMENTS

Figure 1:
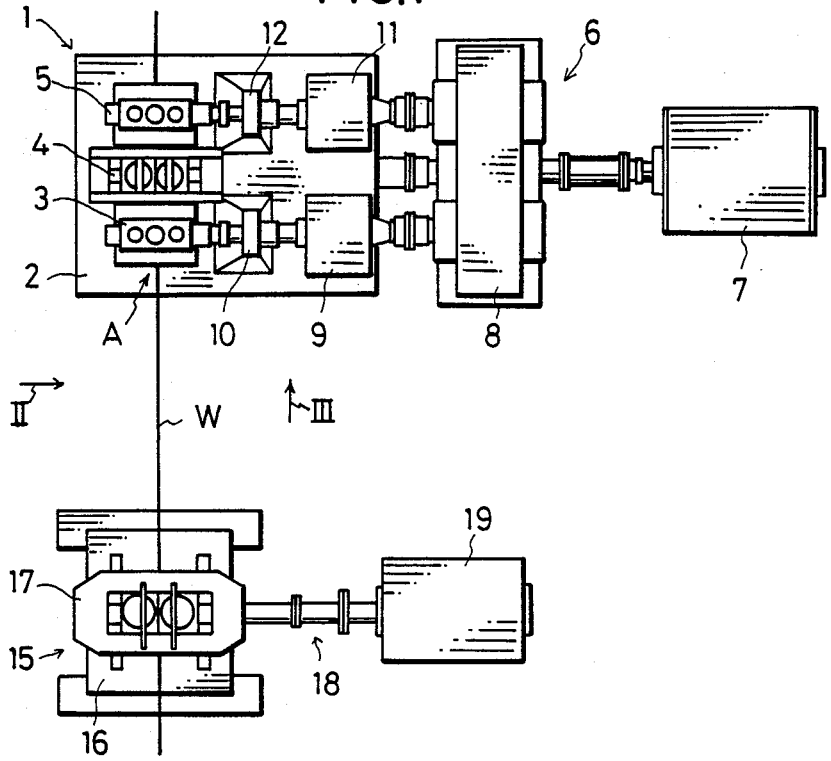
FIG. 1 is a plane view showing a sizing mill and the rolling mill at the last stage in a series of finish rolling mill series.
Figure 2:
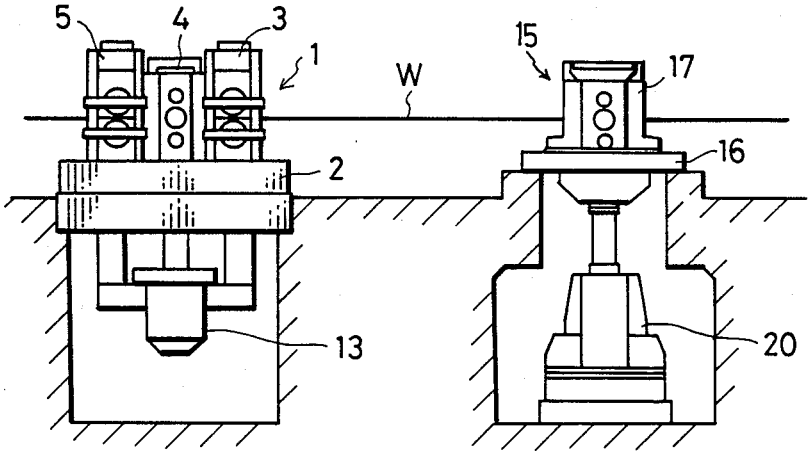
FIG. 2 is a view showing the mills in the direction shown by an arrow II in FIG. 1.
Figure 3:
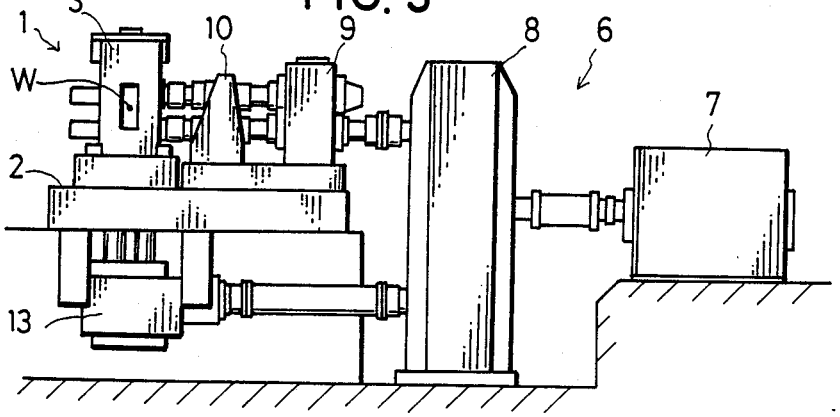
FIG. 3 is a view showing the sizing mill in the direction shown by an arrow III in FIG. 1.

In FIGS. 1 through 3, a sizing mill 1 comprises three roll stands 3, 4 and 5 mounted on a base 2 and a drive means 6 for driving the roll stands. These roll stands 3, 4 and 5 are arranged one by one along a planned passage line A of a roll material. The drive means 6 includes an electric motor 7, a distributing reduction gear 8, a pinion gear box 9 and a spindle carrier 10 for the roll stand 3, a pinion gear box 11 and a spindle carrier 12 for the roll stand 5 and a pinion gear box 13 for the roll stand 4.

In a rolling line including a coarse rolling mill series, an intermediate rolling mill series and a finish rolling mill series, the above mentioned sizing mill 1 is disposed after the finish rolling mill series. In FIGS. 1 and 2, the rolling mill at the last stage of the finish rolling mill series is represented by a reference numeral 15. As is well known, the rolling mill 15 comprises a roll stand 17 mounted on a base 16 and a drive means 18 for the roll stand and the drive means 18 includes an electric motor 19 and a pinion reduction gear 20.

Figure 4:
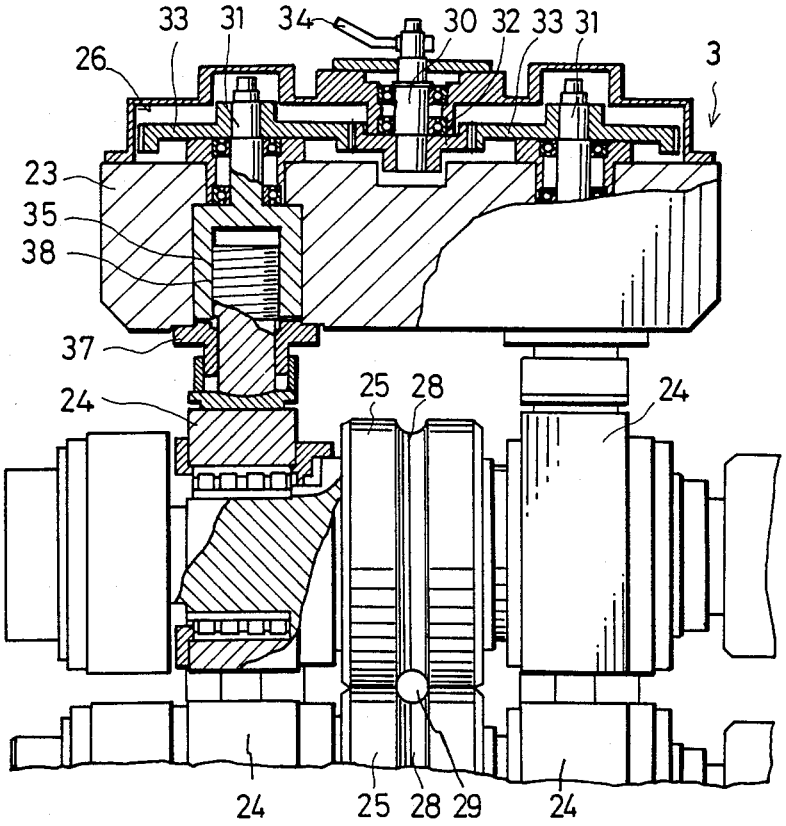
FIG. 4 is a partial front elevation of a roll stand in partial section.
Figure 5:
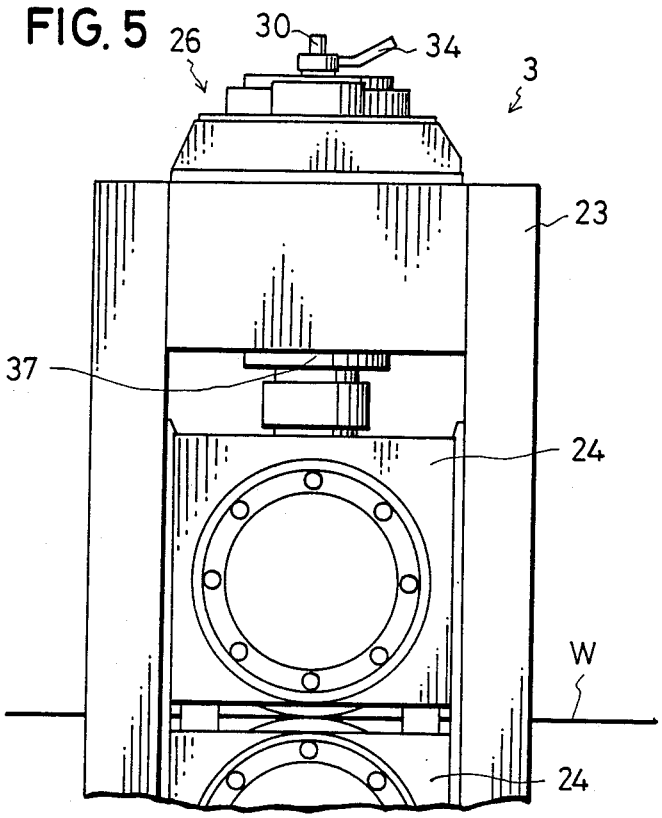
FIG. 5 is a partial side elevation of the roll stand.

In FIGS. 4 and 5, the roll stand 3 is shown in details. As is well known, the roll stand 3 includes a housing 23, four roll chocks 24 mounted in the housing 23 for vertical movement, a pair of rolls 25 and 25 each supported rotatably by the roll chock 24 and a roll distance adjusting means for adjusting the distance between the paired rolls 25 and 25, i.e., a pressing down means 26.

On the outer circumferential surface of each of the rolls 25 and 25 are formed grooves 28 and 28 which define a caliber 29.

The pressing down means 26 comprises an operation axis 30 and work axes 31 and 31 and both axes are connected by gears 32 and 33 for linkage. The operation axis 30 is provided with an adjusting handle 34. The lower portion of the work axis 31 is formed as a hollow cylindrical portion 35, the inside surface of which is formed with a female screw. A pressing down screw 38 is supported for vertical movement by a bearing 37 secured in the housing 23. The outer circumferential surface of the upper portion of the pressing down screw 38 is formed with a male screw which is in threaded engagement with the female screw. The lower end of the pressing down screw 38 is adapted to oppose the upper roll chock 24 so that the lower end may press down the roll chock. The upper roll chock 24 is, in a well known manner, subjected to an upward biasing force by a spring (not shown) provided inside the housing.

The operation of the above mentioned pressing down means 26 is as follows. When the operation axis 30 is rotated by turning the handle 34, the work axis 31 is rotated via the gears 32 and 33. The rotated axis 31 causes the pressing screw 38 to displace upwards or downwards. As the result of the displacement of the screw 38, the upper roll chock 24 is raised under the biasing force or lowered against the biasing force. Consequently, the mutual distance between the upper and lower rolls 25 and 25 is adjusted. The mutual distance between the rolls can be arbitrarily set by such adjustment of the distance between the rolls. The distance once set up can be stably maintained on account of the constructional feature of the pressing down means 26.

Figure 6:
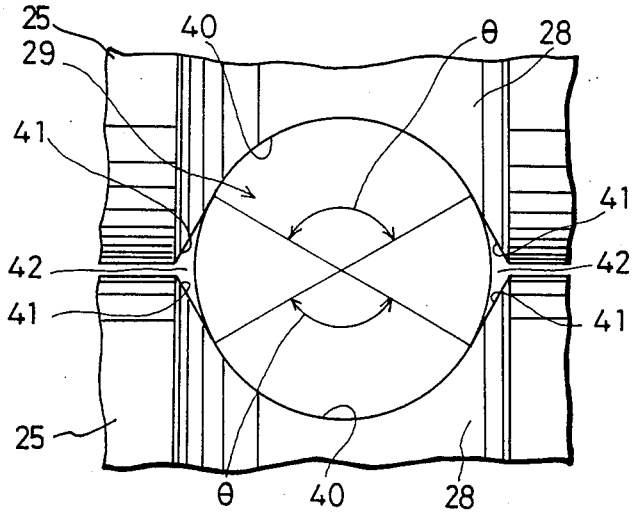
FIG. 6 is front elevation showing the form of a groove on a roll.

In FIG. 6 is shown the detail form of the aforementioned groove 28. The groove 28 consists of a bottom surface 40 and side surfaces 41 and 41 contiguous to both ends of the bottom surface.

The cross section of the bottom surface 40 is a circular arc. The opening angle of the circular arc $\theta$, i.e., the angle formed by a line passing the center and one end of the circular arc and a line passing the center and the other end of the circular arc, is set equal to an arbitrary value selected in an interval of $90° \sim 140°$. For example, the opening angle is 120°. In this embodiment, the cross section of the side surface 41 is a segment of line. This, however, may be a circular arc of a radius larger than that of the circular arc of the bottom surface.

Figure 7:
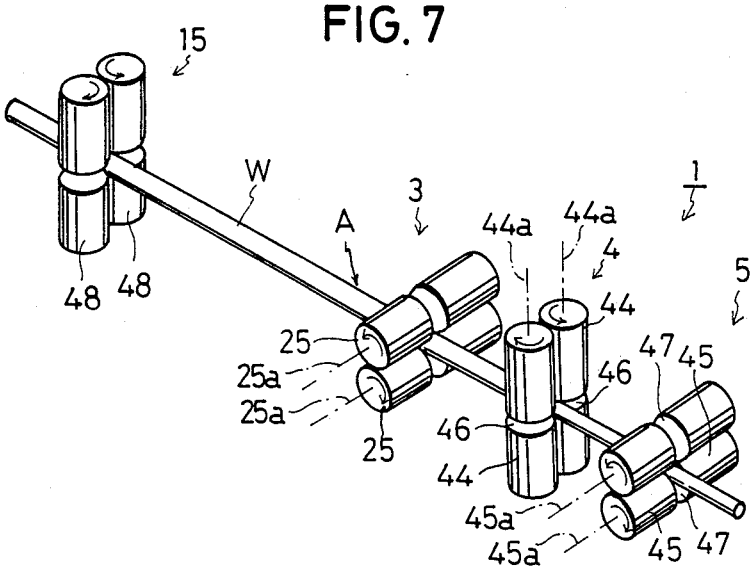
FIG. 7 is a perspective view showing the mutual relationship among a number of rolls of the mills in FIG. 1.

Both the roll stands 4 and 5 are constructed similarly as the above mentioned roll stand 3. The roll stand 4 is different only in that a pair of rolls of the roll stand are arranged to the left and right sides of the planned passage line of roll material. The positional relationship of the rolls in each roll stand is as shown in FIG. 7. Namely, the direction of the axial line 25*a* of the roll 25 in the roll stand 3 differs from the direction of the axial line 44*a* of a roll 44 in the roll stand 4 by 90°. Furthermore, the direction of the axial line 44*a* of the roll 44 in the roll stand 4 differs from the direction of the axial line 45*a* of a roll 45 in the roll stand 5 by 90°. In FIG. 7, grooves of rolls 44 and 45 are represented by reference numerals 46 and 47 respectively. A roll in the roll stand 17 of the aforementioned rolling mill 15 is represented by a reference numeral 48.

Figure 8:
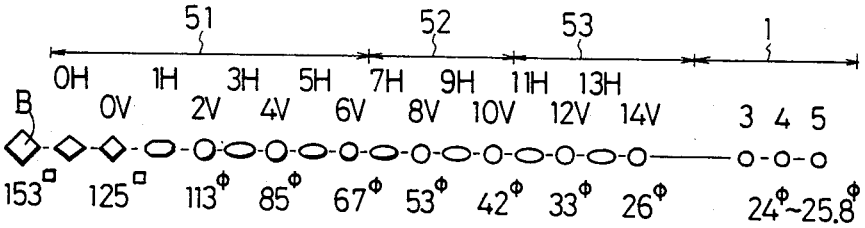
FIG. 8 is a view showing schematically the change of the cross section of a steel billet while it is rolled in order into a finished material.

Now in reference to FIG. 8, the process is described in which a billet is rolled into a product in the form of a round bar. The billet B is rolled in order by plural roll stands 0H~6V in a coarse rolling mill series 51, plural roll stands 7H~10V in an intermediate rolling mill series 52 and plural roll stands 11H~14V in a finish rolling mill series 53. Notations 0H~14V stands for roll stand numbers of a number of roll stands. In these notations, "H" means that a pair of rolls are horizontally disposed and "V" that a pair of rolls are vertically disposed. The stand 14V is the stand 15 shown in FIGS. 1 and 2. The above mentioned billet is rolled by each of the roll stands 0H~14V and takes a cross section of the form as shown in FIG. 8. The principal dimension of the cross section which the billet takes after being rolled by each roll stand is, for example, as indicated by an numeral written under each form of cross section in FIG. 8. The roll material in the form of a round bar which has been rolled by the roll stands 0H~14V is transferred to the sizing mill 1 of FIGS. 1~3 as a roll material W. The roll material W is rolled in order by the roll stands 3, 4 and 5 in the sizing mill 1 and made into a finished material in the form of a round bar of a prescribed diameter.

In the next place, two cases are described by way of example where a finished material 24.24 mm in diameter and a finished material 50.64 mm in diameter respectively are to be obtained. As an example is explained a process in which a roll material S45C 26 mm in diameter is rolled, at a temperature of 900° C., into a finished material 24.24 mm in diameter. In the case of this example, the dimensions of grooves and the distances between rolls in each roll stand, i.e., dimensions R1~R3 and S1~S3 as shown in FIGS. 9A~9D are set equal to the values as listed in Table 1.

TABLE 1

| | roll stand 3 | roll stand 4 | roll stand 5 |
|---|---|---|---|
| radius of circular arc of bottom surface of groove | R1 = 13.00 mm | R2 = 12.12 mm | R3 = 12.12 mm |
| spacing between bottoms of groove | S1 = 24.24 mm | S2 = 24.20 mm | S3 = 24.24 mm |

Figure 9A:
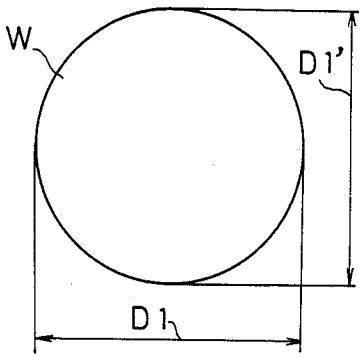
FIGS. 9A through 9D are views for explaining the successive change of the dimension of a roll material while it is rolled by the sizing mill of FIG. 1.
Figure 9B:
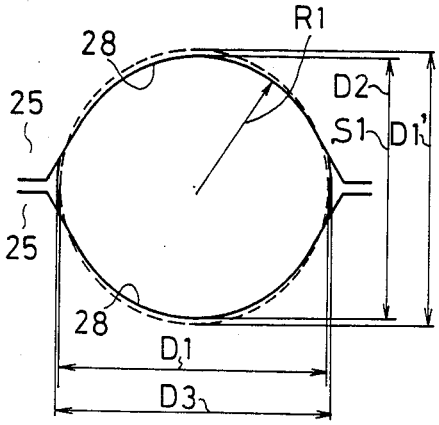
Figure 9C:
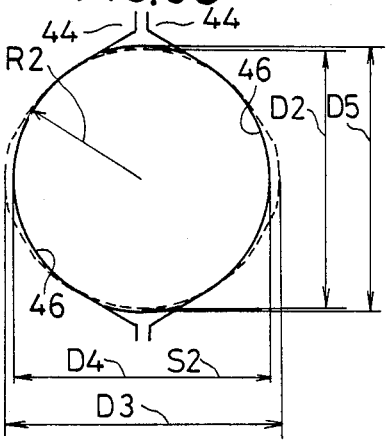
Figure 9D:
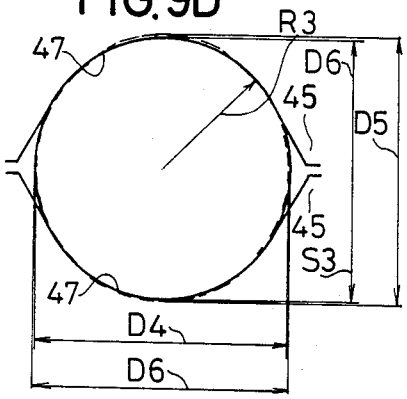
Figure 10:
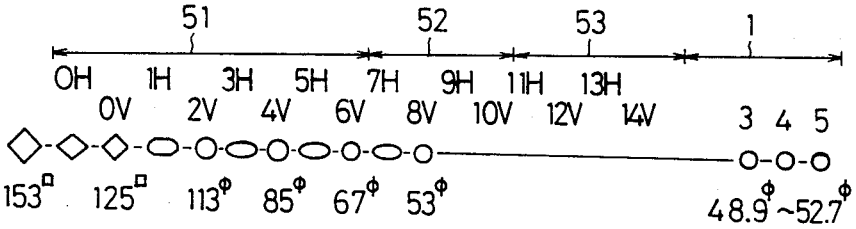
FIG. 10 is a view showing schematically the change of the cross section of the billet while it is rolled in order into a finished material of thickness different from that of the finished material of FIG. 8.

The roll material W which is 26.00 mm in diameters D1 and D1′ as shown in FIG. 9A is first rolled by the rolls 25 of the roll stand 3 and compressed to be 24.24 mm (=S1) in the vertical diameter D2 as shown in FIG. 9B. As a result, the horizontal diameter D3 becomes 26.53 mm. The roll material is then rolled by the rolls 44 of the roll stand 4 and is compressed to be 24.20 mm (=S2) in the horizontal diameter D4 as shown in FIG. 9C. As a result, the vertical diameter D5 is enlarged to 24.64 mm. Next, the roll material is rolled by the rolls 45 of the roll stand 5 and made into a finished material which is 24.24 mm both in vertical and horizontal diameters D6.

In the case of the above mentioned rolling, the rate of area reduction is 7.4% at the roll stand 3, 5.1% at the roll stand 4 and 1.1% at the roll stand 5. The overall rate of area reduction (the rate after the roll material W has been rolled into the finished material) is 13.1%.

The above mentioned steel S45C has an linear expansion coefficient of $11\times10^{-6}$, Accordingly, the finished material just after being produced by rolling becomes a product 24 mm in diameter when the finished material is cooled down to ordinary temperature.

Now another process is described in which a billet of a material different from that of the above mentioned billet, for example, of 52100 (equivalent to SUJ2) is rolled, for example, at a temperature of 850° C. and is formed into a finished material of a diameter different from that of the above mentioned finished material, for example, 50.64 mm. In this case, a material in the form of a round bar 53 mm in diameter, which has been rolled by the roll stand 8V in the intermediate rolling mill series 52, is used as a roll material to be fed to the sizing mill. The roll stands 9H~14V which follow the roll stand 8V are removed from the passage line of the material in the form of a round bar. Dummy guides for supporting the material in the form of a round bar are instead arranged where the removed roll stands were situated. The groove of the roll of each roll stand 3, 4 or 5 in the sizing mill 1 is designed so that the dimensions R1~R3 and S1~S3 may be equal to the following values: R1=26.65 mm, R2=25.50 mm, R3=25.50 mm, opening angle $\theta=110°$, S1=50.64 mm, S2=50.60 mm and S3=50.64 mm A groove corresponding to these dimensions is formed on each roll and the distance between rolls is set by the aforementioned roll distance adjusting means 26.

The roll material 53 mm in diameter is rolled by the roll stands 3, 4 and having rolls of dimensions as established above. Those diameters D1~D5 of the roll material which are indicated in the aforementioned FIG. 9 become the following values and the roll material is made into a finished material 50.64 mm in the diameter D6: D1=53.0 mm, D1′=52.5 mm, D2=50.64 mm, D3=53.56 mm, D4=50.60 mm and D5=51.08 mm The above mentioned steel 52100 has an linear expansion coefficient of $15\times10^{-6}$. Accordingly, the finished material just after being produced by rolling becomes a product 50 mm in diameter when the finished material is cooled down to ordinary temperature.

In the case of the above mentioned rolling, the rate of area reduction is 4.4% at the roll stand 3, 2.8% at the roll stand 4 and 1.7% at the roll stand 5. The overall rate of area reduction is 8.7%.

Next, in the above mentioned sizing mill, a relatively thin (slightly thicker than a product to be rolled) can be rolled into a finished material of prescribed dimensions. Furthermore, a relatively thick material can be rolled as well into a finished material of prescribed dimensions. This point is now described. In a pair of rolls of each roll stand, the groove consists of the bottom surface and the side surfaces contiguous to the both ends of the bottom surface. The cross section of the bottom surface is a circular arc. The opening angle of the bottom surface, i.e., the angle made by a line passing the center and one end of the circular arc and a line passing the center and the other end of the circular arc, is adjusted to be a value selected in an interval of 90°~140°. Accordingly, in the case of the roll stand 3 for example, a relatively large margin space is formed between the side surface 41 of the groove 28 on one of the rolls and the side surface 41 of the groove 28 on the other roll as shown by a reference numeral 42 in FIG. 6. Thus, a relatively thin roll material can be rolled without any trouble. Besides, even a thick roll material can be admitted between the above mentioned grooves 28 and 28. As a result, such a thick roll material can be rolled as well. Since rolling is practiced in this manner in each roll stand, either a relatively thin or thick roll material can be rolled into a finished material of a prescribed diameter.

The above mentioned margin space 42 is larger, the smaller the opening angle is set. Accordingly, the allowable range of the diameter of admittable roll materials becomes the wider. If the opening angle is smaller than 90°, there appears, however, a portion which does not contact with the roll on any occasion while the roll material passed through the roll stands 3, 4 and 5, i.e., a portion which is not rolled. Therefore, the above mentioned opening angle is preferably be determined to be a value larger than 90°. On the other hand, the larger the above mentioned opening angle is, the smaller the margin space 42 becomes and the narrower the above mentioned allowable range becomes. Consequently, it is appropriate to limit the maximum value of the above mentioned opening angle to 140°, considering a general value of deviation in diameter of roll materials to be fed into the sizing mill.

Next is explained a case in which finished materials different slightly in diameter are formed in the sizing mill shown in FIGS. 1 through 7, with the diameter of the roll material transferred to the sizing mill kept unchanged but only by changing the spacing between a pair of rolls in each roll stand. As an example, a case is described where a finished material 48.9 mm or 52.7 mm in diameter is formed in order to provide a product slightly different in diameter from the aforementioned product 50 mm in diameter, for example, a product 48.4 mm or 52.2 mm respectively in diameter. In this case, just the same roll material and the rolls in respective roll stands 3, 4 and 5 that have been used in forming the aforementioned finished material 50.64 mm in diameter are used. Only the aforementioned spacing S1, S2 and S3 are set equal to the values as listed in Table 2.

TABLE 2

| diameter of finished material | S1 | R.A.R. | S2 | R.A.R. | S3 | R.A.R. | R.A.R. |
|---|---|---|---|---|---|---|---|
| 48.9 mm | 48.86 | 8.4% | 48.80 | 4.4% | 48.86 | 3.0% | 15% |
| 52.7 mm | 52.70 | 0.27% | 52.70 | 0.73% | 52.70 | 0.14% | 1% |

R.A.R.: rate of area reduction

With this setting of dimensions, a roll material 53 mm in diameter is rolled by respective roll stands and a finished material 48.9 mm or 52.7 mm in diameter is obtained.

When it is desired to obtain a finished material of a diameter close to the above mentioned 24.24 mm (24.0~25.8 mm for example), a similar process can be taken. Namely, just the same rolls and roll material that have been used in obtaining the finished material 24.24 mm in diameter are used and the spacing between a pair of rolls in each roll stand is set larger for obtaining a finished material of a larger diameter and smaller for obtaining a finished material of a smaller diameter.

Figure 14:
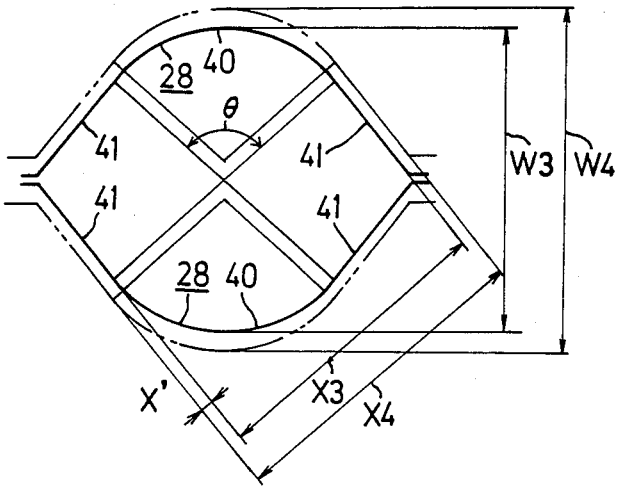
FIG. 14 is a view for explaining the change of the shoulder dimension of the groove when the spacing between rolls is changed in the sizing mill according to the present invention.
Figure 15:
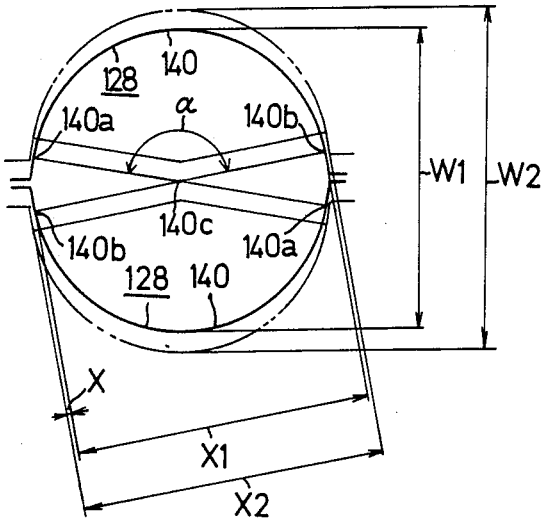
FIG. 15 is a view for explaining the change of the shoulder dimension of the groove when the spacing between rolls is changed in a conventional sizing mill.

The foregoing articles are further explained with reference to FIG. 14 which is drawn in comparison with previously explained FIG. 15. In FIG. 14, the shoulder dimension is X3 (equal to the aforementioned X1) when the spacing between bottom surfaces is W3 (equal to the aforementioned W1). In order to obtain a finished material of a larger diameter the spacing between bottom surfaces is extended from this value to W4 (equal to the aforementioned W2). Then the shoulder dimension is increased to X4. The margin length X' resulting from the increase of the shoulder dimension from X3 to X4 is preserved as a much larger value as shown compared with the value in the case of the aforementioned FIG. 15 since the opening angle $\theta$ is set equal to a small value (100° in FIG. 14). As a result, an almost round finished material can be obtained even when the spacing between bottom surfaces is set equal to W4.

Now the values of the aforementioned opening angle of the groove on the roll and the resulting features are listed in Table 3.

TABLE 3

| | | | | |
|---|---|---|---|---|
| diameter of roll material | | 53 mm | 53 mm | 53 mm |
| diameter of finished material | | 50.50 | 50.50 | 50.50 |
| roll stand 3 | spacing between bottom surfaces of groove | 50.50 | 50.50 | 50.50 |
| | radius of circular arc | 26.50 | 26.50 | 26.50 |
| | opening angle | 120° | 90° | 140° |
| | rate of area reduction | 4.9% | 2.9% | 5.6% |
| roll stand 4 | spacing between bottom surfaces of groove | 50.45 | 50.45 | 50.45 |
| | radius of circular arc | 25.25 | 25.25 | 25.25 |
| | opening angle | 120° | 90° | 140° |
| | rate of area reduction | 3.5% | 3.6% | 3.5% |
| roll stand 5 | spacing between bottom surfaces of groove | 50.50 | 50.50 | 50.50 |
| | radius of circular arc | 25.25 | 25.25 | 25.25 |
| | opening angle | 120° | 90° | 140° |
| | rate of area reduction | 1.1% | 3.0% | 0.4% |
| features | | | Compared with the case of the opening angle 120°, the variable range of the diameter of rolled material is wider but accuracy in dimension is lower. | Compared with the case of the opening angle 120°, accuracy in dimension is higher but the variable range is narrower. |

Next, the roll stands 3, 4 and 5 are preferably arranged, as for the spacings thereamong, in the following manner. Namely, the adjacent two roll stands are arranged such that the distance between the axis of the roll in one of the roll stands and the axis of the roll in the other roll stand may be less than thirty times the diameter of the roll material. The roll material is prevented from being twisted between the adjacent roll stands by such arrangement of the roll stands while the roll material is rolled in order in the respective roll stands 3, 4 and 5. Accordingly, the roll material is first rolled by the rolls of one of the adjacent roll stands and then by the rolls of the other roll stand. Thus the roll material can be rolled over the whole surface thereof without fail. Strictly speaking, the maximum value of the distance between the roll axes varies according to the torsional rigidity which is different for roll materials. For a steel material frequently used, however, it is possible to prevent such a torsion of the roll material as hindering complete rolling by making the maximum value less than thirty times the diameter of the roll material.

Figure 11:
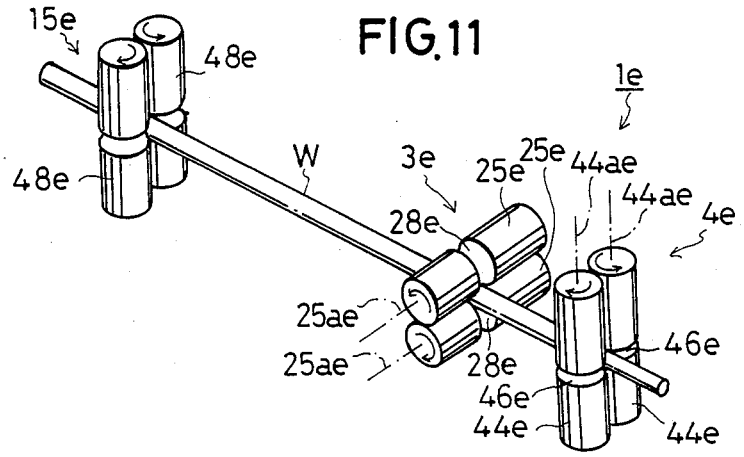
FIG. 11 is a perspective view showing the mutual relationship among rolls when the number of roll stands in the sizing mill is two.

Next, in FIG. 11, similarly as in FIG. 7, is shown the relationship among rolls 25*e* and 44*e* in roll stands 3*e* and 4*e* which are included in a sizing mill 1*e*.

The distance between the axes of rolls in both roll stands 3*e* and 4*e* is preferably less than thirty times the diameter of the roll material in the case of this embodiment as well.

Figure 12A:
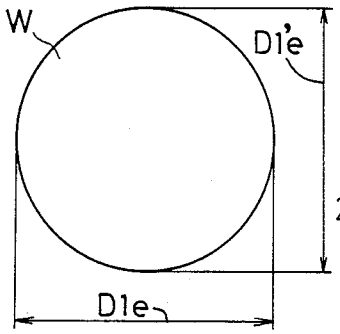
FIGS. 12A through 12C are views showing schematically the change of dimensions of the roll material while it is rolled by the sizing mill with the number of roll stands of two.
Figure 12B:
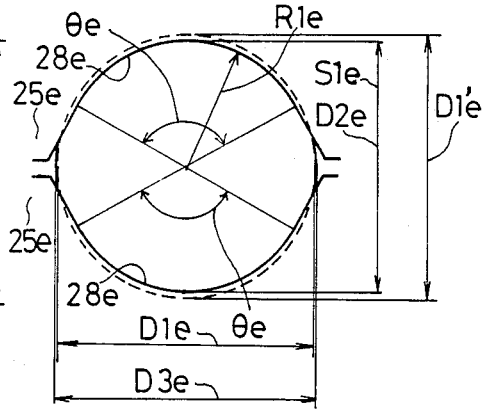
Figure 12C:
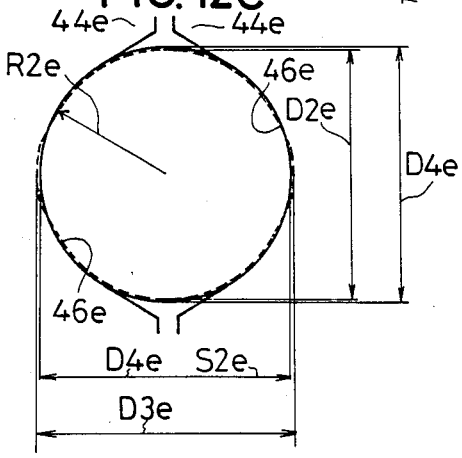

FIGS. 12A through 12C show the process in which a roll material is rolled in the sizing mill including the two roll stands. In reference to these figures is explained the case where a roll material 25 mm in diameters D1*e* and D1'*e* is rolled into a finished material 24.24 mm in diameter. In this case, each of concerning dimensions is set equal to the following values:

R1*e*=12.12 mm, R2*e*=12.12 mm, S1*e*=24.10 mm, S2*e*=24.24 mm and opening angle $\theta=120°$ The roll material 25 mm in the diameters D1*e* and D1'*e* is rolled by the roll stands having rolls with dimensions established above. The roll material is made into a finished material 24.24 mm in the diameter D4*e* via an intermediate material 24.10 mm in the diameter D2*e*(=S1*e*) and 25.18 mm in the diameter D3*e*.

Those members in these figures which can be considered to be same as or equivalent to the members in the previous figures in the light of construction are represented by reference numerals which are same as in the previous figures but with an affixed alphabet e and the explanation of the members is not repeated. (Moreover, same reference numerals with an affixed alphabet f are used in the following figures according to the same idea in order to avoid the repeated explanation of same and equivalent members.)

Figure 13:
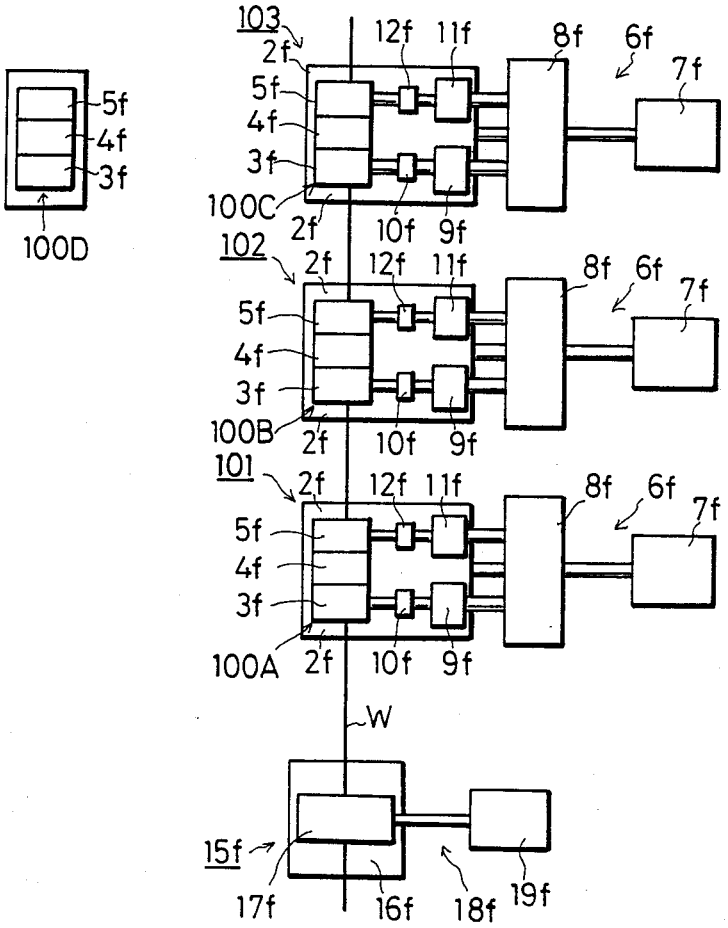
FIG. 13 is a plane view showing a different embodiment of a rolling system.

In FIG. 13 is shown a rolling system by which a product of practically continuously variable diameter can be formed. The rolling system has three sets of sizing mills 101, 102 and 103. Each of the sizing mills 101~103 is provided with a roll stand set 100A, 100B or 100C. More one roll stand set 100D is prepared separately besides these roll stand sets 100A~100C. Each of the roll stand sets 100A~100D comprises three roll stands which are equivalent in construction to the roll stands 3, 4 and 5 as shown in FIGS. 1~3. The roll stand sets differ from one another only in the dimension of the groove on the roll (the radius of the aforementioned circular arc). This dimension is adjusted, before rolling work, such that the roll stand set 100A, for example, is suitable to form a product 24.0~25.8 mm in diameter. Similarly, the dimension is adjusted such that roll stand sets 100B, 100C and 100D are suitable to form products 22.2~23.9, 20.5~22.1 and 30.4~32.8 mm in diameter respectively.

In reference to Table 4, the manufacture of various kinds of products with use of this system is described. Table 4 is an example for the case where products of an arbitrary diameter in an interval 20.5~84.5 mm are manufactured. For manufacturing of such various kinds of products, the orders of various kinds of products are put together collected in advance and a rolling plan is formed. The rolling plan is formed in such a manner that products are manufactured in the increasing order of diameter.

TABLE 4

| | stand number | | | | | | | | | | | | | | | | sizing mill | | | dimensions |
|---|---|---|---|---|---|---|---|---|---|---|---|---|---|---|---|---|---|---|---|---|
| order | 0H | 0V | 1H | 2V | 3H | 4V | 5H | 6V | 7H | 8V | 9H | 10V | 11H | 12V | 13H | 14V | 101 | 102 | 103 | of products |
| 1 | | | | | | | | | | | | | | | | | 100A | 100B | 100C | 20.5ϕ~22.1ϕ |
| 2 | | | | | | | | | | | | | | | | | | | X | 22.2ϕ~23.9ϕ |
| 3 | | | | | | | | | | | | | | | | | | X | X | 24.0ϕ~25.8ϕ |
| 4 | | | | | | | | | | | | | | | X | X | □100D | Δ100B | Δ100C | 25.9ϕ~27.9ϕ |
| 5 | | | | | | | | | | | | | | | X | X | | | X | 28.0ϕ~30.3ϕ |
| 6 | | | | | | | | | | | | | | | X | X | | X | X | 30.4ϕ~32.8ϕ |
| 7 | | | | | | | | | | | | | X | X | X | X | Δ100A | Δ100B | Δ100C | 32.9ϕ~37.6ϕ |
| 8 | | | | | | | | | | | | | X | X | X | X | | | X | 35.7ϕ~38.6ϕ |
| 9 | | | | | | | | | | | | | X | X | X | X | | X | X | 38.7ϕ~41.4ϕ |
| 10 | | | | | | | | | | | X | X | X | X | X | X | Δ100D | Δ100B | Δ100C | 41.5ϕ~44.9ϕ |
| 11 | | | | | | | | | | | X | X | X | X | X | X | | | X | 45.0ϕ~48.8ϕ |
| 12 | | | | | | | | | | | X | X | X | X | X | X | | X | X | 48.9ϕ~52.4ϕ |
| 13 | | | | | | | | | X | X | X | X | X | X | X | X | Δ100A | Δ100B | Δ100C | 52.5ϕ~56.8ϕ |
| 14 | | | | | | | | | X | X | X | X | X | X | X | X | | | X | 56.9ϕ~61.7ϕ |
| 15 | | | | | | | | | X | X | X | X | X | X | X | X | | X | X | 61.8ϕ~66.5ϕ |
| 16 | | | | | | | X | X | X | X | X | X | X | X | X | X | Δ100D | Δ100B | Δ100C | 66.6ϕ~72.2ϕ |
| 17 | | | | | | | X | X | X | X | X | X | X | X | X | X | | | X | 72.3ϕ~78.3ϕ |
| 18 | | | | | | | X | X | X | X | X | X | X | X | X | X | | X | X | 78.4ϕ~84.5ϕ |

( : used, X: not used, □:used exchangeably, Δ: used exchangeably after being cut over)

In the first place, products 20.5~22.1 mm in diameter are manufactured using all the roll stands and all the stand sets 100A~100C mounted in the sizing mills 101~103 as indicated in the line of order 1 in Table 4.

In the next place, the stand set 100C in the sizing mill 103 is removed as shown in the line of order 2 and products 22.2~23.9 mm in diameter are manufactured. While these products are manufactured, the groove on the roll in the removed stand set 100C is cut over again into a shape appropriate to form products 25.9~27.9 mm in diameter.

Next, the stand set 100B of the sizing mill 102 is removed as shown in the line of order 3 and products 24.0~25.8 mm in diameter are manufactured. While these products are manufactured, the groove on the roll in the removed stand set 100B is cut over again into a shape appropriate to form products 28.0~30.3 mm in diameter.

Next, the stand set 100A of the sizing mill 101 is exchanged for the stand set 100D prepared separately as shown in the line of order 4. In the sizing mills 102 and 103 are mounted the stand sets 100B and 100C with rolls which have been appropriately cut over again. In this situation, the roll stands 13H and 14V are not used but all the stand sets 100D, 100B and 100C are used. Thus, products 25.9~27.9 mm in diameter are manufactured.

Furthermore, an operation similar as that in the case of order 2 is carried out in accordance with the line of order 5 and products 28.0~30.3 mm in diameter are manufactured. While these products are manufactured, the rolls of the removed stand set 100C are appropriately cut over again so that the grooves of the rolls may have a shape suitable for manufacturing products 32.9~37.6 mm in diameter with use of the stand set 100C in the next step.

Similar operations as mentioned above are repeatedly carried out according to lines of order in Table 4 and products of required diameters are formed in succession.

The work of exchanging rolls in a rolling installation, in general, takes a relatively long time. Products of much variety in diameter, however, can be obtained by the above mentioned method with a less number of times of exchanging roll stands. Moreover, the work of cutting rolls appropriately over again takes a long time as well. According to the present invention, however, this work can be carried out while the roll stands are not used. Consequently, the rolling work need not be stopped for the work of cutting over and thus can be practiced efficiently.

In passing, Table 5 presents combinations of roll stands in the case where products of variety in diameter are manufactured by a conventional method.

TABLE 5

| order | stand number 0H | 0V | 1H | 2V | 3H | 4V | 5H | 6V | 7H | 8V | 9H | 10V | 11H | 12V | 13H | 14V | dimensions of products |
|---|---|---|---|---|---|---|---|---|---|---|---|---|---|---|---|---|---|
| 1 | | | | | | | | | | | | | | | | | 26 |
| 2 | | | | | | | | | | | | | | | □ | □ | 28 |
| 3 | | | | | | | | | | | | | | | □ | □ | 30 |
| 4 | | | | | | | | | | | | | | | □ | □ | 32 |
| 5 | | | | | | | | | | | | | □ | □ | X | X | 34 |
| 6 | | | | | | | | | | | | | □ | □ | X | X | 36 |
| 7 | | | | | | | | | | | | | □ | □ | X | X | 38 |
| 8 | | | | | | | | | | | | | □ | □ | X | X | 40 |
| 9 | | | | | | | | | | | □ | □ | X | X | X | X | 42 |
| 10 | | | | | | | | | | | □ | □ | X | X | X | X | 44 |
| 11 | | | | | | | | | | | □ | □ | X | X | X | X | 46 |
| 12 | | | | | | | | | | | □ | □ | X | X | X | X | 48 |
| 13 | | | | | | | | | | | □ | □ | X | X | X | X | 50 |
| 14 | | | | | | | | | □ | □ | X | X | X | X | X | X | 55 |
| 15 | | | | | | | | | □ | □ | X | X | X | X | X | X | 60 |
| 16 | | | | | | | | | □ | □ | X | X | X | X | X | X | 65 |
| 17 | | | | | | | □ | □ | X | X | X | X | X | X | X | X | 70 |
| 18 | | | | | | | □ | □ | X | X | X | X | X | X | X | X | 75 |
| 19 | | | | | | | □ | □ | X | X | X | X | X | X | X | X | 80 |

( : used, X: not used, □: interchangeably used or used with calibers reformed)

In the case of this conventional method, diameters of possible products can vary only stepwise. Besides, the work of exchanging roll stands or of changing calibers is required every time when the diameter of products is changed. These works require to stop the rolling line and lower the efficiency in the rolling work. According to the above mentioned present invention, however, these points can be solved.

As many apparently widely different embodiments of this invention may be made without departing from the spirit and scope thereof, it is to be understood that the invention is not limited to the specific embodiments thereof except as defined in the appended claims.

What is claimed is:

1. A sizing mill including two roll stands arranged along a planned passage line of a roll material, each of said roll stands having (a) a housing and (b) a pair of rolls, each said roll having a groove on the circumferential surface thereof and rotatably mounted in said housing, the axial direction of the rolls in one of said roll stands differing by 90 degrees from the axial direction of the rolls in the other of said roll stands;

the groove on each of said rolls having a bottom surface which is a circular arc in cross section, the size of said circular arc being determined such that the angle made by a line passing through the center and one end of said circular arc and a line passing through the center and the other end of said circular arc is in the range of 90 to 140 degrees, both side surfaces being, in cross section, circular arcs having a radius larger than that of the circular arc of said bottom surface.

2. A sizing mill as set forth in claim 1 wherein said pair of rolls are mounted against said housing, said rolls being displaceable toward or away from each other, each of said roll stands further including adjusting means for adjusting the spacing between said pair of rolls.

3. A sizing mill as set forth in claim 1 wherein the distance between the axial line of the roll in one of said two roll stands and the axial line of the roll in the other of said roll stands is less than thirty times the diameter of said roll material.

4. A sizing mill as set forth in claim 1 wherein another roll stand similar in construction to said roll stands and arranged along said planned passage line of said roll material is provided, the axial direction of the roll in each of a series of said roll stands differing by 90 degrees from roll stand to roll stand.

5. A method of rolling a roll material into a finished material comprising the steps of:

providing a sizing mill which includes three roll stands arranged along a planned passage line of a roll material, each of said roll stands having a housing, a pair of rolls provided thereon with respective grooves and mounted in said housing for rotation and mutual displacement and an adjusting means for adjusting the spacing between said pair of rolls, the axial direction of the rolls in each of said roll stands differing by 90 degrees in order from roll stand to roll stand, and said groove on each of said rolls having a bottom surface which is a circular arc in cross section and has such a dimension that the angle made by a line passing through the center and one end of said circular arc and a line passing through the center and the other end of said circular arc is equal to a value selected in the range of 90 to 140 degrees and of both side surfaces which are, in cross section, circular arcs of a radius larger than that of the circular arc of said bottom surface, setting the spacing between the grooves on said pair of rolls in each of said roll stands in accordance with the planned diameter of said finished material; and passing said roll material into said roll stands where said spacings have been set.

6. A method of rolling a roll material into a finished material comprising the steps of:

(a) providing plural serial rolling mills in serial relation;

(b) providing plural sizing mills in serial relation to each other and to said rolling mills and including a last sizing mill;

(c) providing each said sizing mill with a housing and a pair of rolls, each said roll being provided with a groove on the circumferential surface thereof and rotatably mounted in the housing, the axial direction of the rolls in one of said roll stands differing by 90 degrees from the axial direction of the rolls in the next preceding roll stand, the groove on each of said rolls having a bottom surface which is a circular arc in cross section, the size of said circular arc being determined such that the angle made by a line passing through the center and one end of said circular arc and a line passing through the center and the other end of said circular arc is in the range of 90 to 140 degrees, both side surfaces being, in cross section, circular arcs having a radius larger than that of the circular arc of said bottom surface;

(d) adjusting the spacing between the pair of rolls in said last sizing mill;

(e) rolling billets through the rolling mills and the sizing mills;

(f) adjusting the spacing between the pair of rolls in said last sizing mill;

(g) rolling billets through the rolling mills and the sizing mills to produce round bar products larger than produced in step (e);

(h) bringing said last sizing mill into unused state and adjusting the spacing between the pair of rollers in the sizing mill immediately prior to said last sizing mill; and (i) rolling billets through the rolling mills and all but said last sizing mill to produce round bar products of a diameter larger than the products of step (g).

7. A method of rolling a roll material into a finished material comprising the steps of:

(a) providing plural serial rolling mills in serial relation;

(b) providing plural sizing mills in serial relation to each other and to said rolling mills and including a last sizing mill;

(c) providing each said sizing mill with a housing and a pair of rolls, each said roll being provided with a groove on the circumferential surface thereof and rotatably mounted in the housing, the axial direction of the rolls in one of said roll stands differing by 90 degrees from the axial direction of the rolls in the next preceding roll stand, the groove on each of said rolls having a bottom surface which is a circular arc in cross section, the size of said circular arc being determined such that the angle made by a line passing through the center and one end of said circular arc and a line passing through the center and the other end of said circular arc is in the range of 90 to 140 degrees, both side surfaces being, in cross section, circular arcs having a radius larger than that of the circular arc of said bottom surface;

(d) adjusting the spacing between the pair of rolls in said last sizing mill;

(e) rolling billets through the rolling mills and the sizing mills;

(f) bringing said last sizing mill into unused state and adjusting the spacing between the pair of rollers in the sizing mill immediately prior to said last sizing mill; and (g) rolling billets through the rolling mills and all but said last sizing mill to produce round bar products of a diameter larger than the products of step (e).

* * * * *